United States Patent [19]

Struve et al.

[11] Patent Number: 4,754,929

[45] Date of Patent: Jul. 5, 1988

[54] NOZZLE ASSEMBLY FOR FLUID JET CUTTING SYSTEM

[75] Inventors: Richard Struve, Seattle; Gary Ayers, Kent, both of Wash.

[73] Assignee: Flow Systems, Inc., Kent, Wash.

[21] Appl. No.: 62,212

[22] Filed: Jun. 15, 1987

[51] Int. Cl.[4] ..... B05B 1/00

[52] U.S. Cl. ..... 239/591; 239/596; 239/600

[58] Field of Search ..... 239/591, 596, 600; 175/339, 393, 424; 166/222, 223; 299/17

[56] References Cited

U.S. PATENT DOCUMENTS

| | | | |
|---|---|---|---|
| 2,408,892 | 10/1946 | Stokes | 175/393 |
| 3,273,805 | 9/1966 | Hall | 239/600 |
| 3,687,493 | 8/1972 | Lock et al. | 175/393 |
| 3,997,111 | 12/1976 | Thomas et al. | 239/596 |
| 4,150,794 | 4/1979 | Higgins | 239/600 |
| 4,216,906 | 8/1980 | Olsen et al. | 239/591 |
| 4,244,521 | 1/1981 | Guse | 239/596 |
| 4,306,627 | 12/1981 | Cheung et al. | 299/17 |
| 4,660,773 | 4/1987 | O'Hanlon | 239/600 |

*Primary Examiner*—Andres Kashnikow
*Assistant Examiner*—Michael J. Forman
*Attorney, Agent, or Firm*—Ashen Golant Martin & Seldon

[57] ABSTRACT

A nozzle assembly for use with fluid jet cutting systems is disclosed which yields a lower profile, lower mass nozzle assembly, and which permits "finger-tight" assembly of the nozzle.

Briefly, the assembly includes a nozzle housing, a generally tubular closure member (20) having a fluid-accommodating passageway, a collar (36) for positioning a jet-forming orifice (42) with respect to the passageway, and a sealing ring (38) retained to the tubular member by the collar to provide a high pressure seal between the tubular member and the nozzle housing.

11 Claims, 2 Drawing Sheets

NOZZLE ASSEMBLY FOR FLUID JET CUTTING SYSTEM

FIELD OF THE INVENTION

This invention relates to fluid jet cutting systems of the type wherein highly pressurized fluid is formed into a high velocity cutting jet by means of a jet-forming nozzle. More specifically, this invention relates to jet-forming nozzle assemblies used in such systems.

DESCRIPTION OF THE PRIOR ART

Nozzle assemblies of the type used in fluid jet cutting systems typically comprise an axially extending housing having an inlet end, a discharge end, and an axially extending, internal fluid passageway coupling the two ends in fluid communication. Pressurized fluid, such as water at a typical pressure of from 20,000 to 65,000 psi, is introduced at the inlet end of the housing and flows towards the discharge end via the passageway.

A nozzle element, having a jet-forming nozzle orifice, is positioned in the passageway adjacent the discharge end of the housing. The diameter of the jet-forming orifice is typically in the range of 0.002 to 0.040 inches. When the pressurized fluid is forced through the jet-forming orifice, a highly collimated cutting jet is formed having a typical velocity in the order of 1200 fps, or more. The jet thus formed is well known in the art as being capable of precisely cutting a wide variety of materials with distinct advantages over the alternative cutting methods.

It has long been recognized that the orifice element within the nozzle housing must be replaced periodically. Although typically made from an extremely hard and wear resistant material such as synthetic sapphire, the orifice element is subject to wear owing to the extremely high fluid pressures and the rapid acceleration of the fluid as it enters and passes through the orifice. For example, impurities in the fluid impact on the walls of the orifice during operation. Additionally, the fluid within the orifice exerts a cutting force against the orifice walls which change the orifice tolerances over time. The result is that the close tolerances and minimal surface imperfections of the orifice element are lost, and a relatively uncollimated jet of significantly reduced cutting capability is consequently produced.

Prior art nozzle assemblies have required the use of hand tools, to service the nozzle orifice. Examples of typical nozzle assemblies are illustrated and described in U.S. Pat. Nos. 4,216,906, 4,150,794, 3,997,111, and 3,756,106, the contents of which are incorporated by reference. As shown in those references, the orifice element is typically mounted within an annular seating element that is captured between the nozzle housing and an annular end cap tightened onto the discharge end of the nozzle. The housing is provided with an interior or exterior threaded region, according to the particular design, which mates with a threaded region of the cap to permit the aforementioned tightening. The upstream face of the seating element seals against the nozzle housing, while the downstream face of the seating element seals against the end cap so that leakage of the high pressure liquid around the orifice member is prevented.

In practice, assembly of the foregoing nozzle assemblies require the exertion of a substantial amount of torque to the nozzle caps in order to create an effective seal around the orifice member. The torque required must be sufficient to cause metal distortion at the sealing areas, thereby providing an effective metal-to-metal seal capable of withstanding the high working pressures involved.

U.S Pat. No. 4,660,773, incorporated herein by reference, discloses a mining tool which incorporates a number of high pressure nozzles, each including a seal assembly held in place by a set screw. The seal assembly includes a polyethylene sleeve press-fit about and urged up the internally threaded passageway to progressively push the sleeve and orifice member into the housing. The passageway through the screw is co-axially aligned with the jet-forming orifice to permit discharge of the cutting jet therethrough. Seal removal is accomplished by removing the set screw and blowing the sleeve and orifice member out of the housing by pressurizing the cutting fluid upstream thereof.

Accordingly, handtools such as wrenches and the like have been required to both tighten and remove the nozzle cap from the nozzle housing. This apparently minor inconvenience can, in fact, be a major factor in the cost of nozzle maintenance, in that a qualified maintenance technician must often be summoned, where careful use of handtools are required, to attend to the cap removal. This method of maintenance is often reinforced by labor/management contracts in many factories throughout the world. Consequently, the need to change the nozzle orifice can result in significant down time of the system, while the system operator waits for the maintenance technician to arrive.

The present invention is accordingly directed to a nozzle assembly having a sealing arrangement which eliminates the need for hand tools or torque specifications when assembling or disassembling the nozzle, thereby permitting the system operator to perform the operation without the need for a skilled maintenance technician. Further, the seal arrangement described herein is easily installed in, or removed from, the nozzle assembly, and results in a lower profile, lower mass nozzle assembly. Unlike the metal-to-metal seals utilized in the prior art nozzles described above, the sealing arrangement herein does not require high preloads supported by relatively large, massive closure members screw having threads sufficiently large to support the preload force.

SUMMARY OF THE INVENTION

A fluid jet cutting nozzle assembly is disclosed herein comprising a housing having an inlet for permitting the entry of highly pressurized cutting liquid, an outlet end for permitting the discharge of a cutting jet formed from said pressurized cutting liquid, and fluid passageway-defining means communicating between the inlet and outlet end.

A generally tubular closure member is mounted in the outlet end of said housing, and includes an internal conduit in fluid communication with the said passageway for accommodating the discharged cutting jet.

Collar-defining means are affixed to the upstream end portion of said closure member. Sleeve-defining means retained to the closure member by said collar-defining means, provides a high pressure seal between the closure member and the outlet end of said housing. At least one of the collar-defining means and sleeve-defining means is shaped to provide interengagement therebetween, whereby withdrawal of the closure member from the outlet end of the opening causes withdrawal of the sleeve-defining means therefrom.

Jet-defining orifice means are affixed within the internal diameter of said collar-defining means so that withdrawal of the closure member from the outlet end of the housing accordingly causes withdrawal of the orifice-defining means. The orifice communicates with the passageway to form the cutting jet from the pressurized fluid.

DESCRIPTION OF THE PREFERRED EMBODIMENTS

Figure 1:
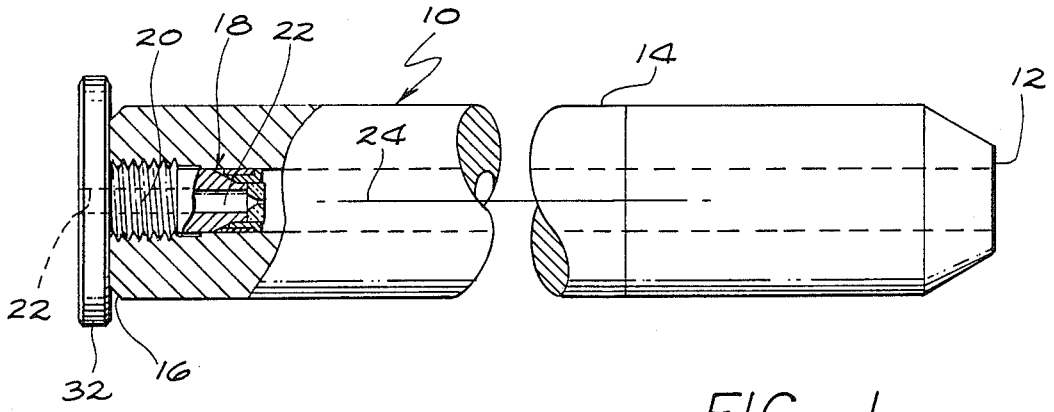
FIG. 1 is an elevation view, in partial section, of a nozzle assembly constructed in accordance with the invention.

Referring initially to FIG. 1, a nozzle assembly is shown to comprise a nozzle housing, or body, 10 having an inlet end 12 for permitting the entry of a highly pressurized cutting fluid such as water. A 0.125 inch diameter fluid passageway 14 within the housing 10 couples the inlet end 12 to an outlet end 16 of the nozzle housing. An orifice subassembly, indicated generally at 18, is mounted in the outlet end of the housing and includes a generally tubular closure member 20 having an internal conduit 22 in fluid communication with the passageway. The orifice subassembly is more clearly illustrated in FIG. 2.

Figure 2:
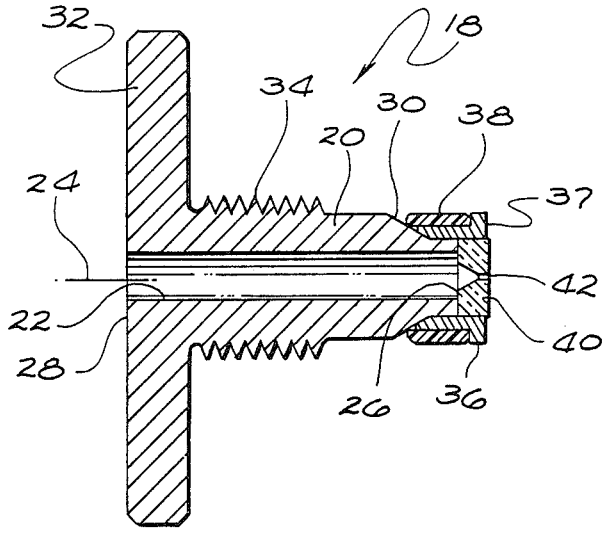
FIG. 2 is an enlarged elevation view, in section, of the orifice and seal subassembly illustrated in FIG. 1.

FIG. 2 is an enlarged elevation view, in section, of the orifice subassembly 18 illustrated in FIG. 1. The subassembly is shown to comprise an annular orifice member 40, having an 0.006 inch orifice 42 through which the cutting fluid passes to form the cutting jet. In FIG. 2, the fluid travels from right to left. The orifice member 40 is affixed to the upstream end of the tubular member 20 by an interference fit with an annular collar 36, which is in turn affixed by means of an interference fit to the tubular member 20. Accordingly, the orifice member 40 is press fit into the upstream portion of the collar 36 during assembly, and the downstream end of the collar 36 is press fit onto the upstream end of the closure member 20.

The tubular closure member 20 is preferably made from a high strength, corrosion resistant material such as hardened stainless steel. A jet-accommodating bore approximately 0.35 inches long, is disposed about an axis 24 and extends through the closure member 20 from its upstream end 26 to its downstream end 28.

The closure member 20 includes a conically shaped neck portion 30 just downstream of its upstream end from the 0.080 inch diameter of the upstream end to a diameter just less than the 0.125 inch diameter of the passageway 14 (FIG. 1). The diameter of the neck portion 30 increases in the downstream direction. The downstream end 28 of the member 20 terminates in a knurled, integral flange 32 which is adapted to be manually rotated during insertion and removal of the subassembly 18 from the nozzle housing. The flange is conveniently sized to have a 0.5 inch diameter.

Just upstream from the flange 32, the member 20 is externally threaded at 34. The threads mate with an internally threaded region within the nozzle housing so that the subassembly 18 can be screwed into the housing during assembly by means of the hand-rotatable flange.

The collar 36 is formeed from a material such as a bronze alloy which has a reasonable modulus of elasticity, resistance to galling by stainless steel and to corrosion, and sufficient strength to retain its grip on the closure member. The collar 36 has an outer diameter of 0.100 inches, an inner diameter of 0.080 inches, and an axial length of 0.60 inches.

As shown in FIG. 2, approximately half of the collar's axial length mates with the closure member as described above. The other, upstream, half of the collar's length accommodates the orifice element 40. The orifice element 40, which is press fit into the collar, is formed from an extremely hard material, such as synthetic sapphire, having a 0.080 inch outer diameter.

An annular plastic ring 38 of approximately 0.100 inch inner diameter, encompasses the collar 36 and, as described below, seals the orifice subassembly 18 within the nozzle housing 10.

During assembly of the subassembly 18, the ring 38 is placed about the upstream neck of the tubular closure member 20, and the collar 36/orifice member 40 combination is press fit onto the closure member. The ring 38 is captured between a radially outwardly extending flange 37, formed on the upstream end of the collar 36, and the conically shaped neck 30 on the tubular closure member 20 which is just downstream from the member's upstream end 26. The ring 38 is thereby urged into the nozzle housing 10 (FIG. 1) by the conical surface of the tubular closure member 20 during insertion of the subassembly 18 into the housing, and is urged out of the nozzle housing by the flange 37 upon withdrawal of the subassembly 18 from the housing.

The use of a plastic ring, rather than a metal ring, reduces the friction generated against the interior of the nozzle housing 10 during installation and removal of the subassembly 18. Consequently, less torque is required to tighten or loosen the subassembly, permitting the amount of torque generated by a human hand to suffice when applied to the flange 32 of the closure member 20.

In practice, it has been found that a ring having a 0.125 inch nominal outer diameter, a 0.100 nominal internal diameter, and a length of 0.60 inches is satisfactory when formed from an organic plastic having a tensile strength of at least 1000 psi, and ductility of at least 0.5 elongation before break at tension.

The sealing of the subassembly 18 within the housing 10 is effected by the working pressure of the cutting fluid, which forces the orifice element 40 against the upstream face of the closure member 20 to prevent bypassing of the orifice 42 by the pressurized fluid. Additionally, the plastic ring 38 seals the extrusion gap between the interior of the nozzle housing 10 (FIG. 1) and closure member 20 by deforming and flowing into the gap therebetween, much like an O-ring or other packing type seal. Because the seal is 37 pressure activated", the high preloads otherwise necessary to effect high pressure sealing are eliminated, thereby eliminating the high torque requirements which would preclude use of "finger-tight" assembly of the device herein.

The subassembly 18, thus described, allows for the handling of the orifice assembly with minimal risk of parts loss or axial misalignment of the orifice 42. The risk of axial misalignment is minimized because the orifice member 40 is mounted coaxially with the passageway 22 by the collar 36.

Figure 3:
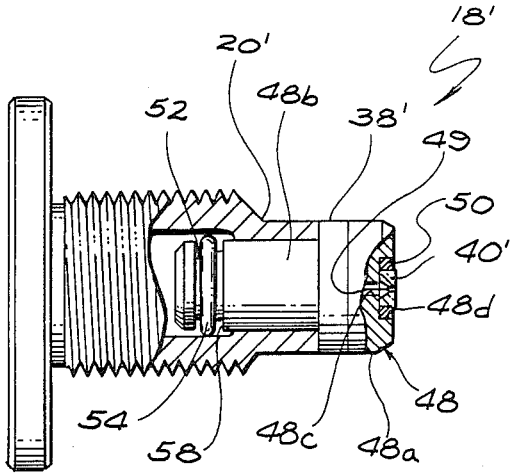
FIG. 3 is an enlarged elevation view, in section, of an alternative orifice subassembly.

FIG. 3 illustrates an alternative embodiment of an orifice subassembly constructed in accordance with the invention. This embodiment includes a collar 48, having a generally "T"-shaped cross section, preferably formed from stainless steel. The collar 48 has an upstream head section 48*a*, which captures a plastic seal ring 38' against the upstream end of the closure member 20', and a downstream stem section 48*b* which is mounted within the closure member 20'. An internal, jet-accommodating, fluid passageway 49 extends upstream through the stem 48*b*, so that the downstream face 48*c* of the stem is in fluid communication with a counterbore 48*d* formed in the upstream face of the head 48*a*. The head 48*a* of the collar 48 is adapted to receive and hold the orifice member 40'. The orifice member 40' is accordingly mounted within an disc-shaped insert 50, and the resulting combination is press fit into the counterbore 48*d*, and held in place by the interference fit. The stem 48*b* of collar 48 is adapted to be retained within the closure member 20' during insertion and withdrawal of the closure member from the nozzle housing. The stem 48*b* is accordingly provided with a circumferential groove 52 sized to retain an O-ring 54 mounted about the stem. Inspection of FIG. 3 will show that internal passageway through the closure member contains a shoulder 58 that imparts an internal diameter to the passageway which is slightly less than the diameter of the O-ring. The shoulder 58 accordingly bears against the O-ring 54 during withdrawal of the subassembly 18' from the nozzle housing, thereby pulling the collar 48, orifice member 40' seal ring 38' from the nozzle housing. In practice, a subassembly 18' adapted for use in a nozzle housing having a 0.25 inch internal diameter comprises a closure member 20' having an upstream end whose diameter is approximately 0.25 inches, thereby providing a close fit between that portion of the closure member and the interior wall of the nozzle housing. The internal diameter of the closure member 20' is approximately 0.20 inches in the region downstream from the shoulder 58, and approximately 0.1875 inches above the shoulder to provide for compression of the O-ring 54. The closure member 20' is approximately 0.625 inches in length, and measures 0.20 inches from the upstream end to the shoulder.

The collar 48 comprises a annular head portion 48*a* having a 0.250 inch outer diameter, and a 0.094 inch nominal thickness.

A counterbore of approximately 0.094 inches is formed in the head portion 48*a* of the collar 40 to accommodate the orifice member 40' and insert 50. The passageway of 0.031 inches extends axially downstream from the counterbore, and terminates in a coaxially aligned passageway formed in the stem portion 48*b* having a diameter of 0.094 inches.

The plastic seal ring 38' which is captured loosely between the head portion 48*a* of collar 48 and the upstream end of the closure member 20', has a 0.250 inch outer diameter, a 0.187 inch internal diameter, and a thickness of approximately 0.063 inches.

During assembly, the subassembly 18' is constructed by press fitting the orifice member 40' and insert 50 into the counterbore 48*d* of the collar 48. The O-ring 52 is installed on the stem 48*b* of the collar. The plastic seal ring 38' is placed against the upstream face of the closure member. The collar 48 is then inserted, stem first, into the upstream end of the closure member's passageway. The passageway upstream of the shoulder 58 is sized to compress the O-ring radially inward so that the O-ring passes through the region circumvented by the shoulder. Upon passing the shoulder, the O-ring is permitted to revert to its natural diameter by the larger diameter of the passageway downstream of the shoulder.

As in the first embodiment, the illustrated subassembly 18' may conveniently be screwed into the nozzle housing by means of the hand-rotatable annular flange 32' integrally formed with the closure member at its downstream end. The pressurized working fluid within the nozzle housing forces orifice member 40' the insert 50 and the head 48*a* of the collar 48 to seal against each other, and causes the head 48*a* to squeeze the seal ring 38' against the upstream end of the closure member 20'. It may be noted from FIG. 3 that the resulting slight downstream movement of the stem 48*b* and its O-ring is unimpeded. The seal ring 38', like the plastic seal ring 38 of the first embodiment, seals the extrusion gap between the interior of the nozzle housing 10 and the closure member 20'.

The cutting jet accordingly passes from the orifice in member 40', through passageway 49 in the stem 48*b*, and is directed through the central hole in the annular flange 32' to cut the workpiece.

While the foregoing description includes detail which will enable those skilled in the art to practice the invention, it should be recognized that the description is illustrative and that many modifications and variations will be apparent to those skilled in the art having the benefit of these teachings. It is accordingly intended that the invention herein be defined solely by the claims appended hereto and that the claims be interpreted as broadly as permitted in light of the prior art.

We claim:

1. A fluid jet cutting nozzle assembly comprising:

a housing having an inlet for permitting the entry of highly pressurized cutting liquid, an outlet end for permitting the discharge of a cutting jet formed from said pressurized cutting liquid, and a fluid passageway communicating between the inlet and outlet end;

a generally tubular closure member mounted in the outlet end of said housing, and having an internal conduit extending between its upstream and downstream ends in fluid communication with the said passageway for accommodating the discharge cutting jet;

collar-defining means for positioning an orifice-defining surface at the upstream end of the closure member so that an orifice is in the path of the pressurized fluid in the housing passageway;

ring means retained to the closure member by said collar-defining means to provide a high pressure seal between the tubular closure member and the outlet end of said housing;

the collar-defining means and ring means being interengaged, whereby withdrawal of the closure member from the outlet end of the housing causes withdrawal of the ring means from the outlet end of the housing; and jet-defining orifice means affixed within the internal diameter of said collar-defining means and communicating with the passageway for forming the cutting jet from the pressurized fluid, said jet-defining orifice means including said orifice-defining surface and said orifice, whereby withdrawal of the closure member from the outlet end of the housing causes withdrawal of the orifice means.

2. The nozzle assembly of claim 1 wherein the collar-defining means is affixed to the upstream end of the closure member.

3. The nozzle assembly of claim 2 wherein the ring means circumvents at least a portion of the collar-defining means.

4. The nozzle assembly of claim 3 wherein the collar-defining means circumvents the upstream end portion of the closure member.

5. The nozzle assembly of claim 4 wherein the collar-defining means has an outwardly extending surface positioned to engage the ring means upon withdrawal of the closure member from the nozzle housing.

6. The nozzle assembly of claim 5 wherein the closure member includes a region of greater cross sectional dimension than the internal diameter of the ring means, said region being positioned to contact the downstream end of the ring means whereby the ring means is captured between said region and the outwardly extending surface of the collar-defining means.

7. The nozzle assembly of claim 5 wherein the outwardly extending surface is located at the upstream end of the collar-defining means.

8. The nozzle assembly of claim 7 wherein the outwardly extending surface is oriented to engage the upstream edge of the ring means.

9. The nozzle assembly of claim 1 wherein said collar-defining means comprises a member of a generally "T"-shaped section having a generally annular head portion accommodating the jet-defining orifice means, and a generally tubular stem portion extending axially therefrom, the stem portion being nested within the internal passageway of the closure member so that the head portion extends from the upstream end thereof, the head portion being sufficiently axially spaced from the upstream end of the closure member to accommodate the ring therebetween; and means within the closure member for retaining the stem portion therein so as to captively retain the ring means between the head portion and the closure member during withdrawal of the closure member from the nozzle housing.

10. The nozzle assembly of claim 1 including hand-grippable means affixed to the closure member for rotatingly mounting the member within the housing with sufficient force to permit subsequent operation of the cutting nozzle with the hand-mounted closure member.

11. For use in a fluid jet cutting nozzle assembly of the type including a housing having an inlet for permitting the entry of highly pressurized cutting liquid, an outlet end for permitting the discharge of a cutting jet formed from said pressurized cutting liquid, and a fluid passageway communicating between the inlet and outlet end, and jet-defining orifice means at the outlet end of said housing, an orifice subassembly comprising:

a generally tubular closure member adapted to be mounted in the outlet end of said housing, and having an internal conduit extending between its upstream and downstream ends positioned to be in fluid communication with the said passageway for accommodating the discharge cutting jet;

collar-defining means for positioning the jet-defining orifice means at the upstream end of the closure member so that an orifice in the jet-defining orifice means is in the path of the pressurized fluid in the housing passageway;

ring means retained to the closure member by said collar-defining means to provide a high pressure seal between the tubular member and the outlet end of said housing; and the collar-defining means and ring means being interengaged, whereby withdrawal of the closure member from the outlet end of the housing causes withdrawal of the ring means from the outlet end of the housing.

* * * * *